US008290420B2

(12) United States Patent
Morishita

(10) Patent No.: US 8,290,420 B2
(45) Date of Patent: Oct. 16, 2012

(54) IMAGE CARRIER UNIT WITH CLEANING PORTION AND IMAGE FORMING APPARATUS EQUIPPED WITH SAME

(75) Inventor: Hiroki Morishita, Osaka (JP)

(73) Assignee: Kyocera Mita Corporation (JP)

( * ) Notice: Subject to any disclaimer, the term of this patent is extended or adjusted under 35 U.S.C. 154(b) by 291 days.

(21) Appl. No.: 12/767,883

(22) Filed: Apr. 27, 2010

(65) Prior Publication Data

US 2010/0272484 A1 Oct. 28, 2010

(30) Foreign Application Priority Data

Apr. 28, 2009 (JP) ..... 2009-109935

(51) Int. Cl.
*G03G 21/00* (2006.01)

(52) U.S. Cl. ..... 399/351; 399/343; 399/353

(58) Field of Classification Search ..... 399/351, 399/343, 123, 353
See application file for complete search history.

(56) References Cited

U.S. PATENT DOCUMENTS

| | | | | |
|---|---|---|---|---|
| 5,241,350 | A * | 8/1993 | Bigelow | 399/351 |
| 6,658,223 | B2 * | 12/2003 | Nishimura et al. | 399/102 |
| 2003/0156870 | A1 * | 8/2003 | Byun et al. | 399/356 |
| 2005/0238987 | A1 * | 10/2005 | Ohshima et al. | 430/125 |
| 2007/0230990 | A1 * | 10/2007 | Ogasawara et al. | 399/101 |
| 2008/0226334 | A1 | 9/2008 | Ohno et al. | |

FOREIGN PATENT DOCUMENTS

| | | |
|---|---|---|
| JP | 8-137248 | 5/1996 |
| JP | 9-258624 | 10/1997 |

* cited by examiner

*Primary Examiner* — Walter L Lindsay, Jr.
*Assistant Examiner* — Roy Y Yi
(74) *Attorney, Agent, or Firm* — Gerald E. Hespos; Michael J. Porco

(57) ABSTRACT

The present invention includes an image carrier unit, configured to carry a toner image including: an image carrier member configured to carry the toner image and a cleaning portion configured to clean the image carrier unit. The cleaning portion includes a cleaning blade. The cleaning blade includes a blade portion in contact with the image carrier member and a holder configured to partially surround and hold the blade portion. The holder includes a crimping claw portion which latches the blade portion.

12 Claims, 7 Drawing Sheets

IMAGE CARRIER UNIT WITH CLEANING PORTION AND IMAGE FORMING APPARATUS EQUIPPED WITH SAME

CROSS-REFERENCE TO RELATED APPLICATION

This application claims priority to Japanese Patent Application Serial Number 2009-109935, filed on Apr. 28, 2009 by at least one common inventor, and which is incorporated herein by reference in its entirety.

BACKGROUND OF THE INVENTION

1. Field of the Invention

The present invention relates to an image carrier unit including a cleaning portion as well as to an image forming apparatus equipped with the unit.

2. Description of the Related Art

Various image forming apparatuses employ an electrophotography method to form a toner image on a sheet. In the electrophotography method, an exposure device irradiates an image forming surface of a photosensitive drum charged by a charger with light so as to form an electrostatic latent image. A developer supplies toner to the photosensitive drum, so that the toner adhering to the electrostatic latent image forms the toner image. The toner image is then transcribed and fixed onto the sheet. After the transcription of the toner image to the sheet, the image formation surface is cleaned, so that toner still remaining on the image formation surface is removed. After that a new toner image is formed on the image formation surface, and then transcribed and fixed onto a new sheet.

The toner removal is performed with a cleaning blade, for example, disposed downstream from a position where the toner image on the image formation surface is transcribed. The cleaning blade in contact with the image formation surface removes residual toner from the image formation surface. The toner removal with the cleaning blade may also be applied to the developer.

The cleaning blade typically includes a metal support and a rubber blade. A double-sided tape or an instant adhesive, for example, are used to fix the blade to the support. It may take a longer curing time to fix the blade to the support with the double-sided tape or the instant adhesive, and strength of the fixation between them has to be well controlled. Another method for fixing the blade to the support is thermal fusion. The fixation method with the thermal fusion, however, takes time for preheating process. Thus, no conventional fixation between the cleaning blade and the support is likely to contribute to reduction in a manufacturing cost because of a longer manufacturing time.

Screws and spacers may be used for fixing the blade to the support as yet another method, which may be likely to, however, increase a number of parts and require a larger space for accommodating the cleaning blade. Thus the method with the screws and the spacers is less likely to contribute to miniaturization.

Another drawback in the conventional toner removal process with the cleaning blade relates to removal of toner adhering to surfaces other than the image formation surface. In many cases, there are elongated strip regions, which are not subjected to the image formation process, adjacent to the image formation surface. In many cases, characteristics of toner adhering to the elongated strip regions are different from the residual toner adhering to the image formation surface. Therefore the conventional cleaning blade may not effectively remove the toner from the elongated strip regions.

SUMMARY OF THE INVENTION this invention aims to provide an image carrier unit and image forming apparatus allowing a cleaning blade to be mounted more easily than the prior arts.

An image carrier unit configured to carry a toner image according to one aspect of the invention includes: an image carrier member configured to carry the toner image; and a cleaning portion configured to clean the image carrier member, wherein the cleaning portion includes a cleaning blade, the cleaning blade includes a blade portion in contact with the image carrier member, and a holder configured to partially surround and hold the blade portion, and the holder includes a swaged claw portion configured to bite into the blade portion.

An image forming apparatus configured to form a toner image according to another aspect of the invention includes: an image carrier member configured to carry the toner image; a developer configured to form the toner image on the image carrier member; a relay unit to which the toner image is transcribed; the relay unit supplying the toner image to the sheet; and a cleaning portion configured to clean the image carrier member after transcription of the toner image to the relay unit, wherein the cleaning portion includes a cleaning blade, the cleaning blade includes a blade portion in contact with the image carrier member, and a holder configured to partially surround and hold the blade portion, and the holder includes a swaged claw portion configured to bite into the blade portion.

An image forming apparatus configured to form a toner image according to yet another aspect of the invention includes: an image carrier member configured to carry the toner image; a developer configured to form the toner image on the image carrier member; and a cleaning portion configured to clean the image carrier member after transcription of the toner image to the sheet, wherein the cleaning portion includes a cleaning blade, the cleaning blade includes a blade portion in contact with the image carrier member, and a holder configured to partially surround and hold the blade portion, and the holder includes a swaged claw portion configured to bite into the blade portion.

DETAILED DESCRIPTION OF THE PREFERRED EMBODIMENTS

An embodiment of the present invention is described below. The term "sheet" used in the following description means any sheet material on which a toner image may be formed, such as photocopier paper, overhead projector sheets, postcards, and the like. Further, "a leading edge of the sheet" and similar terms mean an edge leading a conveyed sheet. The terms "front", "back", "right", "left", "above", "below", and similar terms indicating directions solely aims to facilitate to understand the present invention, and does not intend to limit the scope of the present invention.

Figure 1:
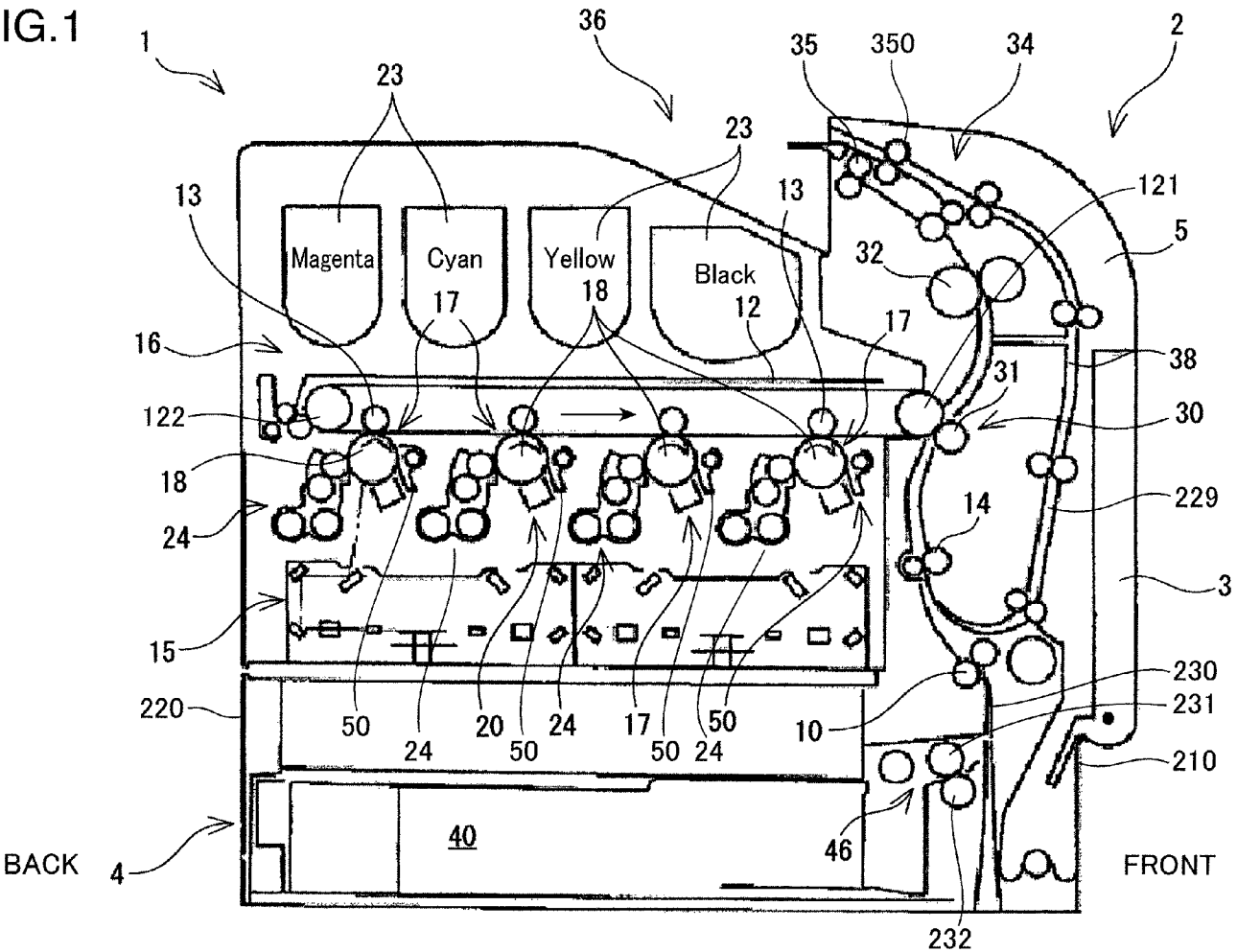
FIG. 1 is a schematic view of the configuration of the printer according to one embodiment of the invention.

FIG. 1 schematically shows a structure of a color printer 1. The printer 1 is exemplarily shown as an image forming apparatus but the image forming apparatus may be a photocopier, a fax machine, a multifunction device combining their functions or any other device capable of toner image formation. The printer 1 in FIG. 1 is depicted from the left, therefore a front wall 210 of the printer 1 is shown on the right while the rear wall 220 is shown on the left.

The printer 1 includes a housing 2 configured to accommodate various devices for forming images. A manual feed tray 3 is rotatably mounted on the front wall 210 of the housing. The housing 2 includes a front cover 5 above the manual feed tray 3. A plurality of operation keys and an operation panel showing operation information to a user may be mounted on the front cover 5 although these are not shown in FIG. 1. The user may input any desired operation through the operation panel. A feed cassette 4 accommodated in a lower portion of the housing 2 includes an accommodation portion 40 configured to accommodate stacked sheets. A pickup roller 46 is disposed above the accommodation portion 40. The pickup roller 46 in contact with the leading edge of the sheet in the accommodation portion 40 transports the sheet from the feed cassette 4.

A delivery path 230 between the front wall 210 of the housing 2 and the accommodation portion 40 guides the sheet from the feed cassette 4. The delivery path 230 vertically extends along the front wall 210 of the housing 2 and guides the sheet from the feed cassette 4 toward a discharge roller 35 disposed in an upper portion of the housing 2. The sheet subjected to the image formation process is discharged to the outside of the housing 2 by the discharge roller 35, and then accumulates in the discharge tray 36 forming an upper surface of the housing 2.

The user may pull the feed cassette 4 in the front direction of the printer 1 (to the right in FIG. 1) to replenish the pulled-out feed cassette 4 with new sheets. Alternatively, the user may replace the sheets in the feed cassette 4 with another type of sheets.

A feed roller 231 and a dividing roller 232 are disposed after the pickup roller 46. The sheet fed from the accommodation portion 40 by the pickup roller 46 is supplied to the delivery path 230 by the feed roller 231. The dividing roller 232 rotates in a direction to return the sheet to the accommodation portion 40. If the pickup roller 46 feeds a plurality of sheets from the accommodation portion 40, the dividing roller 232 returns the sheets except for the sheet directly in contact with the feed roller 231, to the accommodation portion 40. Thus the sheet is fed one by one to the delivery path 230.

A delivery roller 10, a resist roller 14, an image formation portion 16 and a transcription portion 30 are placed along the delivery path 230. The delivery roller 10 sends the sheet fed to the delivery path 230 by the feed roller 230 toward the resist roller 14 which then sends the sheet to the image formation portion 16 in synchronized timing with the image formation process by the image formation portion 16.

Figure 2:
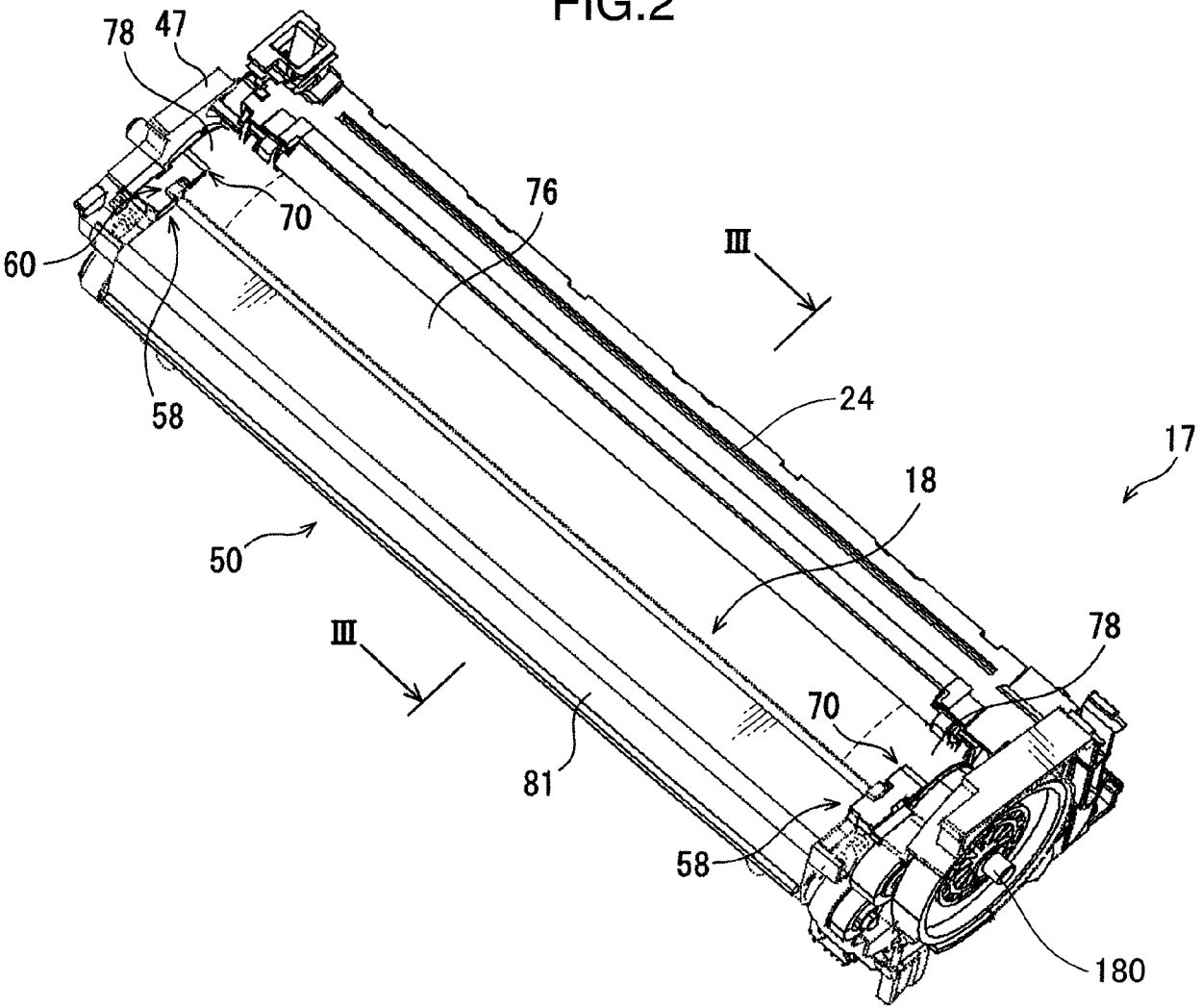
FIG. 2 is a perspective view of a drum unit shown in FIG. 1.
Figure 3:
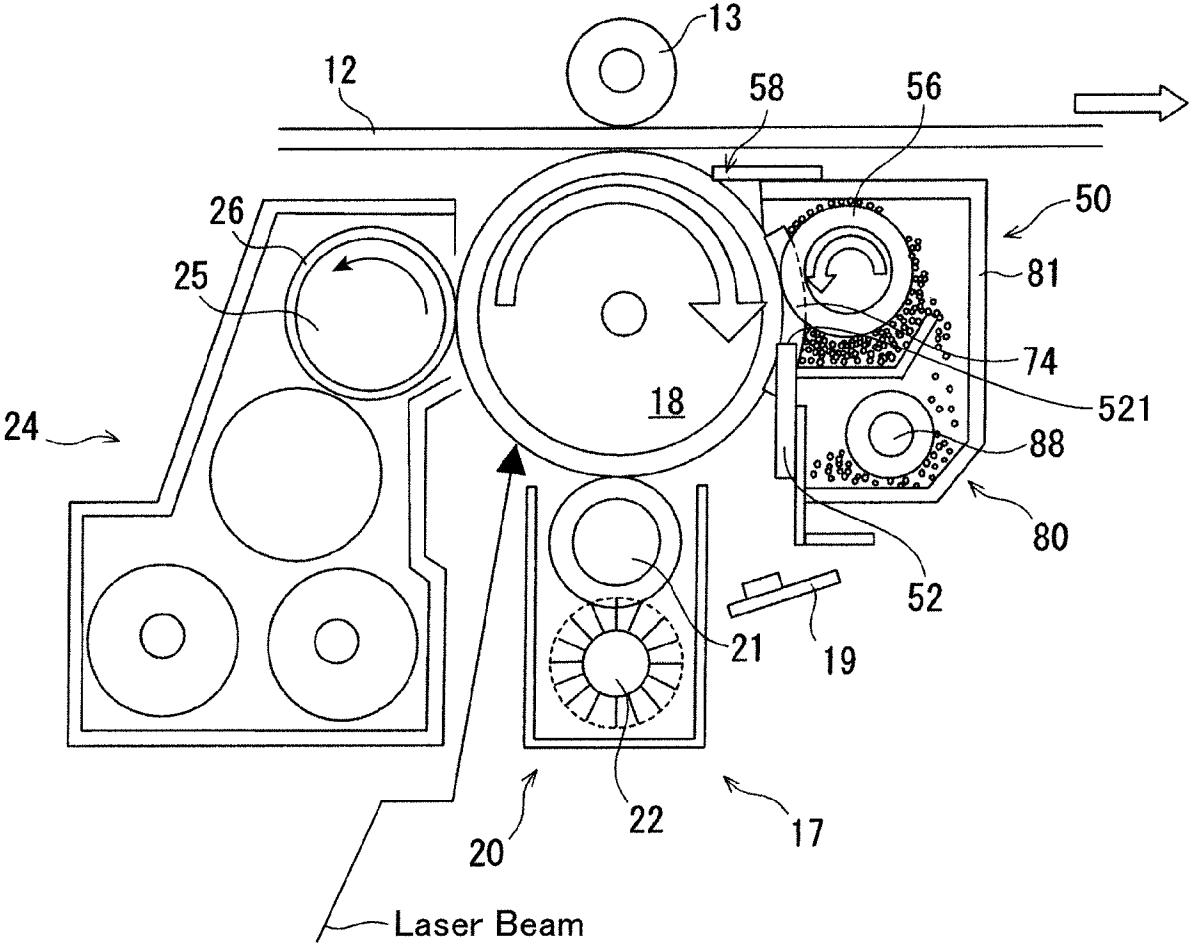
FIG. 3 is a cross-sectional view along line III-III shown in FIG. 2.

FIG. 2 is a perspective view of a drum unit of the image formation portion 16. FIG. 3 is a cross-sectional view along line III-III in FIG. 2. The image formation portion 16 is described referring to FIG. 1 as well as FIGS. 2 and 3.

As shown in FIG. 1, the image formation portion 16 includes four drum units 17 between the front wall 210 and the rear wall 220. In the present embodiment, each of the drum units 17 serves as an image carrier unit configured to carry a toner image. Each drum unit 17 includes a photosensitive drum 18 to be rotated by a driving motor (not shown) (in FIG. 1, the photosensitive drums 18 rotate in the clockwise direction). For example, the photosensitive drums 18 of a-Si drums may be preferable. A circumferential surface of the a-Si drum is covered with a layer of an amorphous silicon-based material.

The image formation portion 16 further includes an exposure unit 15 disposed between the photosensitive drums 18 and the feed cassette 4. The exposure unit 15 irradiates the circumferential surface of each photosensitive drum 18 with laser light. The image formation portion 16 further includes chargers 20, developers 24, intermediate transcription rollers 13, cleaning portions 50, and an intermediate transcription belt 12 around the photosensitive drums 18.

As shown in FIG. 2, both ends of a rotation shaft 180 of the photosensitive drum 18 are rotatably supported by a housing 47 of the drum unit 17. A lower-side circumferential surface and an upper-side circumferential surface of the photosensitive drum 18 are exposed on the outside of the housing 47. As shown in FIGS. 1 and 3, the charger 20 below the housing 47 of the drum unit 17 includes a brush roller 22 below the photosensitive drum 18 and a charging roller 21 between the brush roller 22 and the photosensitive drum 18. The charging roller 21 makes contact with the brush roller 22 and the lower circumferential surface of the photosensitive drum 18, which is exposed on the outside of the housing 47. The charging roller 21 uniformly charges the circumferential surface of the photosensitive drum 18 (that is, the first region 76 in which an image is formed). The brush of the brush roller 22 scrubs the charging roller 21 to clean its circumferential surface. Laser light from the exposure device 15 irradiates the first region 76 charged by the charging roller 21. As a result, charge in the first region 76 partially disappears, so that an electrostatic latent image corresponding to a desired image is formed.

The developer 24 on the left of the photosensitive drum includes a developing roller 25, which is rotated counter-clockwise in FIG. 3 by a driving motor (not shown). The developing roller 25 supplies toner to the first region 76 of the photosensitive drum 18. The toner from the developing roller 25 electrostatically adheres to the electrostatic latent image in the first region 76. As a result, the toner image corresponding to the desired image is formed in the first region 76.

As shown in FIG. 1, the intermediate transcription belt is disposed above the drums 18. Four toner containers 23 configured to replenish the developers 24 with the toner are placed between the intermediate transcription belt 12 and the discharge tray 36. The toner containers 23 include a magenta toner container configured to supply magenta toner; a cyan toner container configured to supply cyan toner; a yellow toner container configured to supply yellow toner; and a black toner container configured to supply black toner. The capacity of the black toner container is the largest. These toner containers supply the toner to the developers 24 of the respective drum units 17 therebelow.

The intermediate transcription belt 12 extends between the photosensitive drum 18 and the intermediate transcription rollers 13. The intermediate transcription belt 12 is pressed against the first region 76 by the intermediate transcription rollers 13. While the intermediate transcription belt 12 runs between the photosensitive drum 18 and the intermediate transcription roller 13, the toner image on the first region 76, which is formed by toner supplied from the developer 24, is transcribed onto the intermediate transcription belt 12. The magenta toner container supplies the toner to the developer 24 of the furthest upstream drum unit 17 in the image formation process. Therefore the toner image formed by the magenta toner (magenta toner image) is first formed on the intermediate transcription belt 12. The drum unit 17 supplied the toner from the cyan toner container adjacent to the magenta toner container applies a toner image formed by the cyan toner (cyan toner image) onto the magenta toner image. The drum unit 17 supplied the toner from the yellow toner container adjacent to the cyan toner container applies a toner image formed by the yellow toner (yellow toner image) onto the magenta toner image and the cyan toner image. Finally, the drum unit 17 supplied the toner from the black toner container applies a toner image formed by the black toner onto the magenta toner image, cyan toner image and yellow toner image.

The intermediate transcription belt 12 is wound around a driving roller 121 near the front wall 210 and a driven roller 122 near the rear wall 220. The transcription portion 30 includes the driving roller 121 and a transcription roller 31 adjacent to the driving roller 121. The transcription roller 31 is in pressing contact with the intermediate transcription belt 12 on the driving roller 121 to define a nip portion toward which the sheet from the resist roller 14 moves. In the nip portion, the toner image formed with the magenta toner, the cyan toner, the yellow toner and the black toner as described above is transcribed onto the sheet. Thus, in this embodiment, the intermediate transcription belt 12 and the driving roller 121 are used as a relay unit configured to relay the toner image from the first region 76 to the sheet. Alternatively, the toner image formed in the first region 76, however, may be transcribed directly to the sheet.

The sheet subjected to the transcription of the toner image by the transcription portion 30 is sent to the fixing portion 32, which applies heat energy and pressure to the sheet carrying the toner image to fix the toner image. Thereafter, the sheet is sent to the discharge roller 35 configured to discharge the sheet outside the housing 2. The sheets discharged outside the housing 2 are stacked on the discharge tray 36.

When the user inputs an instruction for double-sided printing to the image forming apparatus 1 through the operation panel, a bifurcated discharge portion 34 switches a delivery path of the sheet from the delivery path directing to the discharge roller 35 to another delivery path toward a switchback roller 350 above the discharge roller 35. The switchback roller 350 performs switchback operation to feed the sheet outside the housing 2 by a prescribed amount, and then pull back the sheet into the housing 2. The sheet pulled into the housing 2 is sent to a returning delivery path 229 formed between the delivery path 230 and the front wall 210. The returning delivery path 229 guides the sheet before the resist roller 14. Thereafter, the sheet is sent from the resist roller 14 to the image forming portion 16 in synchronized timing with the image formation process in the image formation portion 16. In the image forming portion 16, the toner image is transcribed onto a blank surface of the sheet (the surface on which a toner image has not been formed). Thereafter, a new toner image on the sheet is fixed by the fixing portion 32. Finally, the sheet is discharged outside the housing 2 by the discharge roller 35.

The cleaning portions are described referring to FIGS. 1 and 2. The drum unit 17 includes the cleaning portion 50 configured to remove the toner adhering to the circumferential surface of the photosensitive drum 18 after the transcription of the toner image to the intermediate transcription belt 12. A casing 81 for collecting the toner removed from the photosensitive drum 18 and second cleaning blades 58 to remove the toner adhering to both ends of the photosensitive drum 18 are shown in FIG. 2. The casing 81 forms a portion of the housing 47 of the drum unit 17 together with the developer 24. As shown in FIG. 2, the circumferential surface of the photosensitive drum 18 includes the first region 76 in which toner images are formed as described above and second regions 78 adjacent to the first region 76. The second cleaning blades 58 primarily remove the toner adhering to the second regions 78.

The cleaning portion 50 is further described with referring further to FIG. 3. The cleaning portion 50 includes a first cleaning blade 52 and the second cleaning blades 58. The first cleaning blade 52 primarily abuts the first region 76 of the circumferential surface of the photosensitive drum 18, in which the toner images are formed. The first region 76 is used as an image carrier surface. The second cleaning blades 58 primarily abut the second regions 78 adjacent to the first region 76 (narrow strip regions on the outsides of the first region 76). The second cleaning blades 58 remove the toner from the photosensitive drum 18 before the first cleaning blade 52. The first cleaning blade 52 may, for example, include a main body, which may be made from a zinc coated steel plate, mounted on the casing 81, and a polyurethane rubber blade portion, which may be heat-fused onto the main body. The tip edge of the blade portion makes contact with the first region 76 of the photosensitive drum 18.

A cleaning portion 50 further includes a toner recovery portion 80 which includes, in addition to the above-described casing 81 for collecting the toner, a scrubbing roller 56 disposed in the casing 81. The scrubbing roller 56 scrubs the image formation region between the first cleaning blade 52 and the second cleaning blades 58. The scrubbing roller 56 is driven in counterclockwise rotation, opposite the photosensitive drum 18 which rotates clockwise. A circumferential surface speed of the scrubbing roller 56 is slower than that of the photosensitive drum 18, so that the scrubbing roller 56 scrubs the first region 76 of the photosensitive drum 18. Thus the scrubbing roller 56 suitably removes the residual toner adhering to the first region 76, which is formed with a layer of an amorphous silicon-base material. The first cleaning blade 52 removes the residual toner adhering to the first region 76 after the toner removal with the scrubbing roller 56. The toner removed from the first region 76 by the scrubbing roller 56 and the first cleaning blade 52 is collected in the casing 81.

The toner recovery portion 80 further includes a screw 88 disposed in the casing 81. The screw 88 extending substantially in parallel with the photosensitive drum 18, transports the collected toner in the casing 81 to a prescribed recovery container (not shown) provided outside the casing 81.

Figure 4:
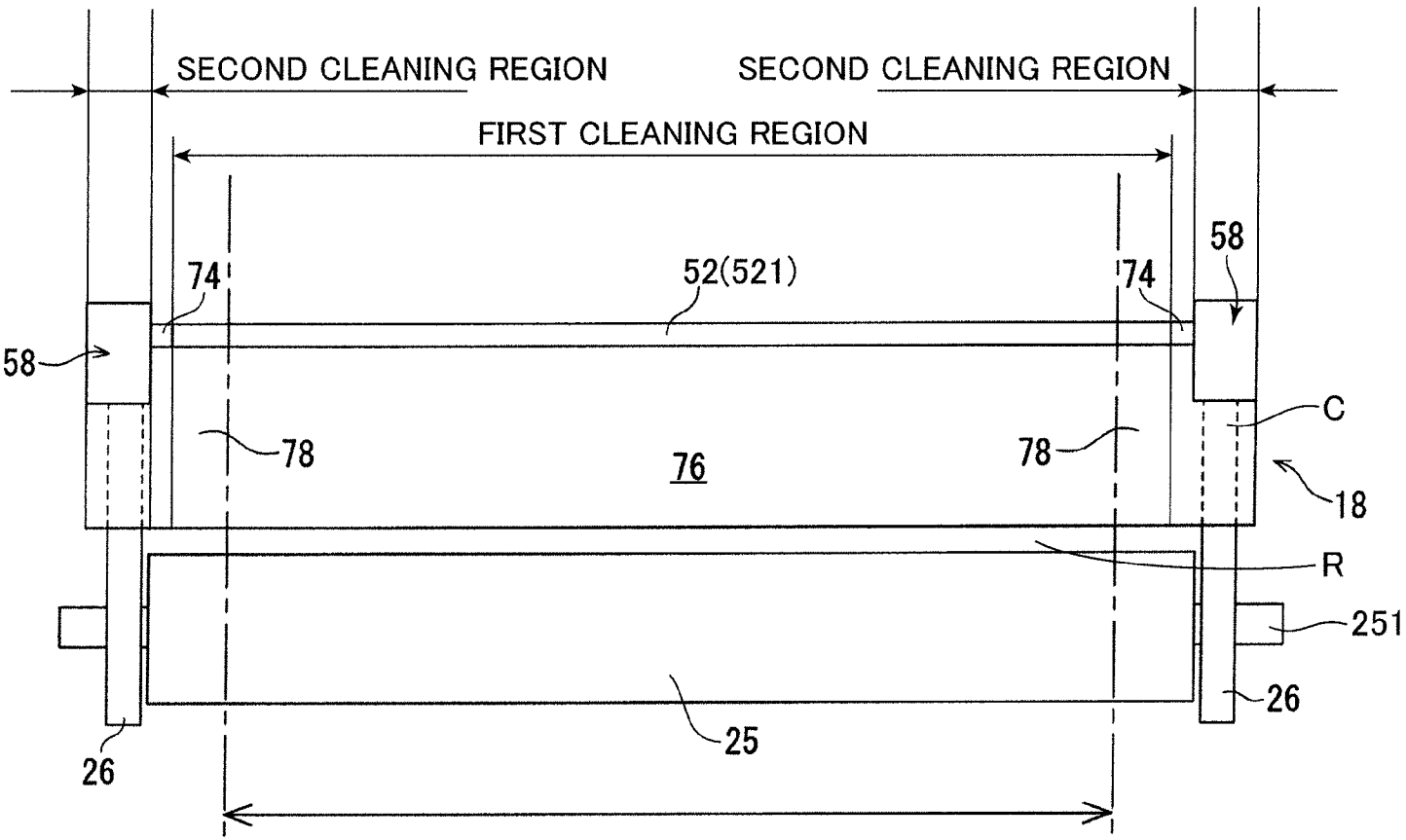
FIG. 4 is a plane view schematically showing a positional relationship between a developer and a photosensitive drum shown in FIG. 3.

FIG. 4 is a schematic plane view of the drum unit 17 shown in FIG. 3. The cleaning portion 50 is further described referring to FIG. 3 together with FIG. 4.

The tip edge 521 of the first cleaning blade 52 extends along a generatrix of the photosensitive drum 18. The first cleaning blade 52 extends downward along a tangent direction to the photosensitive drum 18 from the tip edge 521 confronting rotation of the photosensitive drum 18.

Narrow strip seal members 74 are provided adjacent to side edges of the first cleaning blade 52 extending downward from the tip edge 521. The seal members 74 extending upward (upstream) beyond the tip edge 521 of the first cleaning blade 52 make contact with the second regions 78 of the photosensitive drum 18. For convenience, the region to be subjected to the toner removal process by the first cleaning blade 52 is called the first cleaning region while the regions to be subjected to the toner removal process by the second cleaning blades 58 are called the second cleaning regions. The seal members 74 clean the narrow strip regions between the first cleaning region and the second cleaning regions. The seal members 74 are formed from a soft material such as, for example, felt or sponge. The seal member 74 forms a seal wall configured to absorb the residual toner scattered during cleaning by the first cleaning blade. The above-described scrubbing roller 56 is disposed before the first cleaning blade 52. The scrubbing roller 56 removes the toner from the first cleaning region between the tip edge 521 of the first cleaning blade 52 and the pair of the seal members 74. Thus the toner scattered during the toner removal process by the scrubbing roller 56 is similarly absorbed by the seal members 74.

A gap R is defined between the circumferential surface of the developing roller 25 and the circumferential surface of the photosensitive drum 18 to effect smooth movement of the toner from the developing roller 25 to the photosensitive drum 18. In order to fix the gap R, discs 26 adjacent to both ends of the developing roller 25 are mounted on the shaft 251 of the developing roller 25. The discs 26 are formed with a larger diameter than the developing roller 25. The discs 26 of which circumferential edges abut the circumferential surface of the photosensitive drum 18 define a distance from the circumferential surface of the developing roller 25 to the circumferential surface of the photosensitive drum 18.

In FIG. 4, the regions C surrounded with dashed lines are contact regions in which the discs 26 make contact. The pair of the second cleaning regions includes the contact regions C. The pair of the second cleaning blades 58 removing toner adhering to the regions C maintains the gap R between the circumferential surface of the developing roller 25 and the circumferential surface of the photosensitive drum 18 during rotation of the shaft 251.

Figure 5:
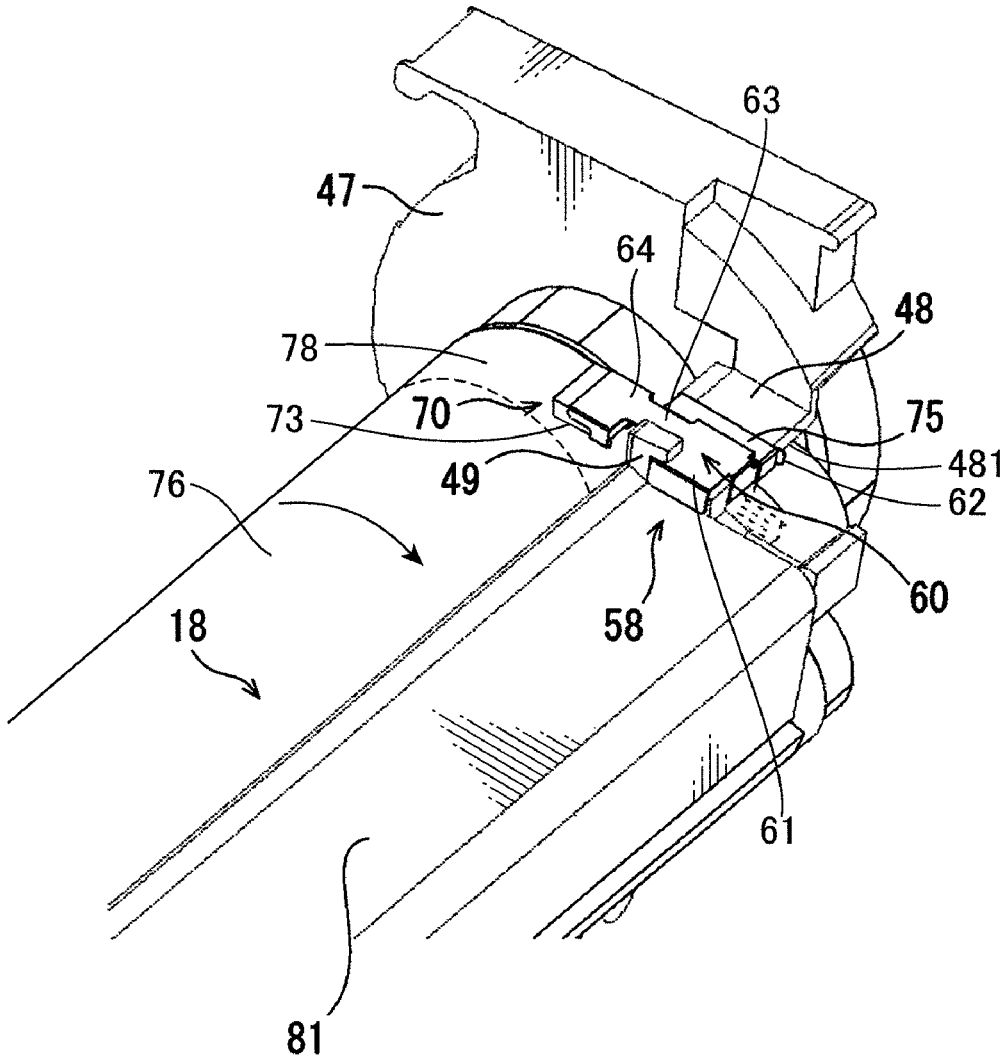
FIG. 5 is an enlarged perspective view of a second cleaning blade mounted on the drum unit.
Figure 6A:
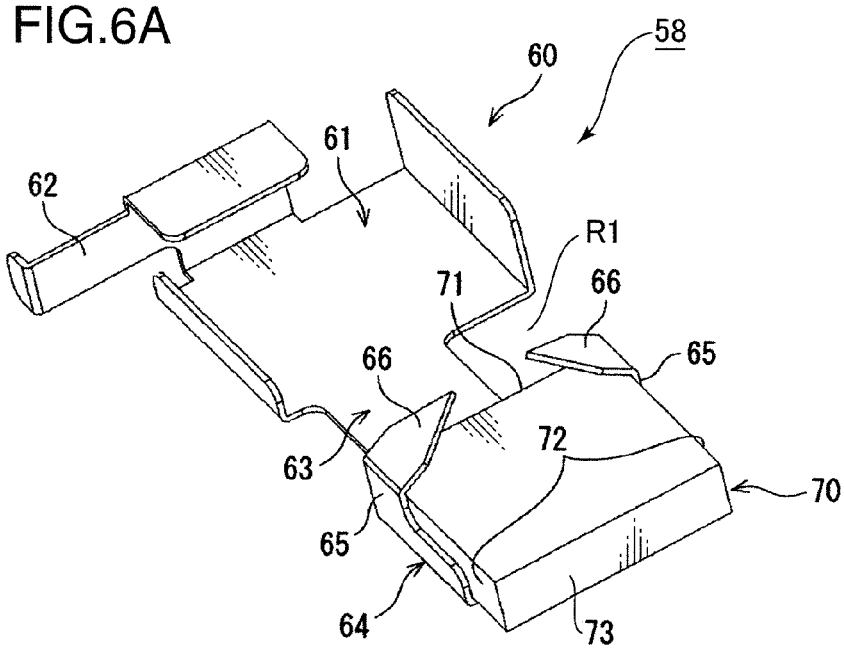
FIG. 6A is a perspective view of the second cleaning blade detached from the drum unit.
Figure 6B:
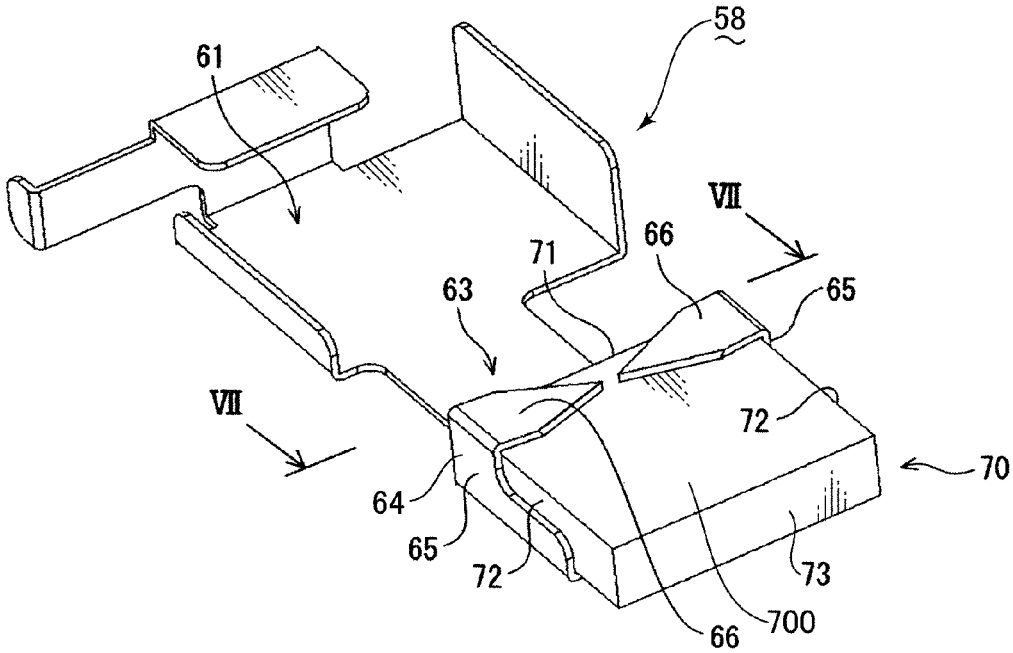
FIG. 6B is a perspective view of the second cleaning blade detached from the drum unit.
Figure 7:
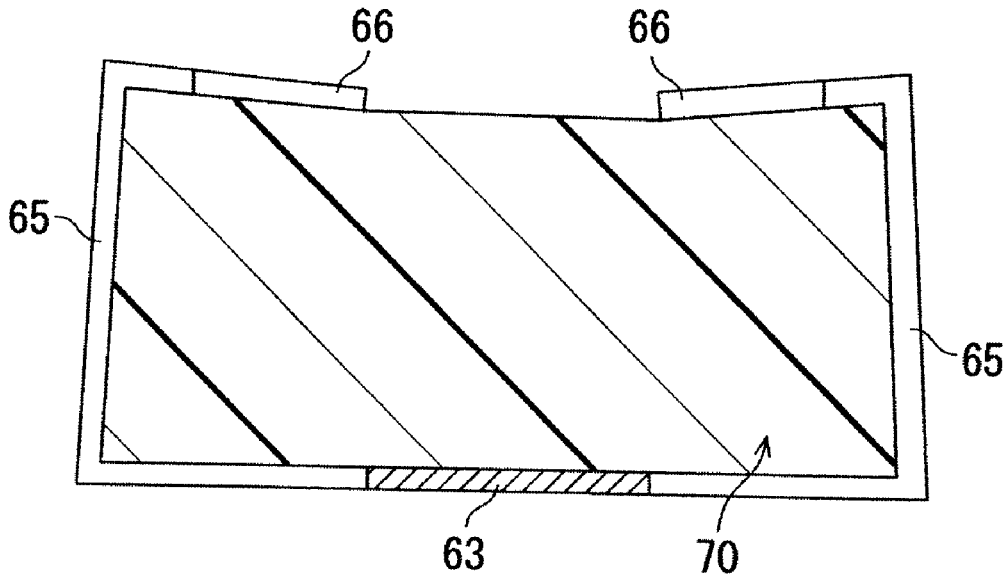
FIG. 7 is a cross-sectional view along line VII-VII shown in FIG. 6B.

FIG. 5 is an enlarged perspective view of the second cleaning blade 58 mounted on the drum unit 17. FIG. 6A and FIG. 6B are perspective views of the second cleaning blade 58 detached from the drum unit 17. FIG. 6A shows the second cleaning blade 58 including a blade portion 70 before attachment to a holder, and FIG. 6B shows the second cleaning blade 58 including the blade portion 70 after the attachment to the holder. FIG. 7 is a cross-sectional view along line VII-VII in FIG. 6B. The second cleaning blade 58 is described referring to FIG. 3, together with FIGS. 5, 6A, 6B and 7.

The housing 47 of the drum unit 17 includes a support plate 48 extending in a horizontal direction from an end surface of the casing 81 of the toner recovery portion 80. The second cleaning blade 58 is mounted on the support plate 48. The housing 47 further includes a substantially inverse-L shaped engaging piece 49 extending upward from a boundary between the casing 81 and the support plate 48. The second cleaning blade 58 engages with the engaging piece 49 so as to be fixed on the support plate 48. As shown in FIG. 5, the engaging piece 49 pinches the second cleaning blade 58 together with the support plate 48. Thus the second cleaning blade 58 is stabilized on the support plate 48.

The second cleaning blade 58 includes a holder 60 and the blade portion 70 abutting the second region 78. A base portion 61 of the holder 60 engages with the above-described engaging piece 49 to be fixed to the support plate 48 by a C-shaped metal clamp 75. The blade portion 70 may be for example formed from a polyurethane rubber. The holder 60 may be for example formed from a stainless steel or other leaf spring member approximately 0.2 mm thick.

As shown in FIG. 6, the holder 60 includes the base portion 61 connected to the support plate 48, a tip portion 64 configured to hold the blade portion 70 and a flexible portion 63 between the base portion 61 and the tip portion 64. As clearly shown in FIGS. 3 and 5, the tip portion 64, the flexible portion 63 and the base portion 61 are arranged along the intermediate transcription belt 12 (that is, along a first direction opposite to the movement direction of the second region 78). A lower surface of the base portion 61 abuts an upper surface of the support plate 48. The edge portion of the base portion 61 distanced from the tip portion 64 is bent into a positioning piece 62 to be disposed along a rear edge 481 of the support plate 48 distanced from the photosensitive drum 18. The positioning piece 62 is pinched between the clamp 75 and the rear edge 481.

The tip portion 64 may be substantially as wide as the base portion 61. The flexible portion 63 may be narrower than the tip portion 64 or the base portion 61. As a result, a space R1 into which the engaging piece 49 is inserted is defined between the tip portion 64 and the base portion 61.

The substantially rectangular parallelepiped blade portion 70 held by the tip portion 64 includes a tip surface 73 which makes contact with the second region 78, a rear surface 71 on the opposite side of the tip surface 73, and lateral surfaces 72 extending between two side edges of the tip surface 73 and two side edges of the rear surface 71.

Each of two side portions of the tip portion 64 is bent at two locations into a grasping portion 65 and a claw portion 66 further extending from the grasping portion 65. The pair of the grasping portions 65 is disposed along the pair of the lateral surfaces 72 of the blade portion 70, respectively. The pair of the claw portions 66 is disposed along a lower surface 700 of the blade portion 70. The grasping portions 65 and the claw portions 66 define a space to partially accommodate the blade portion 70. As shown in FIG. 6A, the tip portion 64 is initially lightly bent into the grasping portions 65 and the claw portions 66. After the blade portion 70 is set in the tip portion 64 such that the rear end portion of the blade portion 70 is surrounded with the grasping portions 65 and the tapered claw portions 66, the grasping portions 65 and the claw portions 66 are tightly bent and swaged. When the swaged claw portions 66 are bent to such an extent as to slightly bite into the blade portion 70 (see FIG. 7), the blade portion 70 is latched by the swaged claw portions 66 without other fastening means such as adhesive and is fixed to the holder 60. The blade portion 70 protrudes from the tip portion 64 of the holder 60.

After the blade portion 70 is connected to the holder 60, the holder 60 is connected to the support plate 48. First, the engaging piece 49 is inserted into the space R1. Then, the holder 60 is moved toward the photosensitive drum 18 along the upper surface of the support plate 48. When the positioning piece 62 abuts the rear edge 481 of the support plate 48, the engaging piece 49 engages with the base portion 61 of the holder 60. Then, the clamp 75 is mounted on the support plate 48 such that the clamp 75 pinches the support plate 48 and the positioning piece 62 along the rear edge 481 of the support plate 48. Thus the tip surface 73 of the blade portion 70 protrudes in the above-described first direction opposing the movement direction of the second region 78 of the rotating photosensitive drum 18, and scrapes away the toner adhering to the second region 78.

Operation of the cleaning portion 50 is described, referring again to FIG. 3.

An eraser lamp 19 irradiates the circumferential surface of the photosensitive drum 18 with light to cancel charging of the circumferential surface of the photosensitive drum 18. Then, as described above, the charger 20 uniformly charges the circumferential surface of the photosensitive drum 18.

Further, thereafter the electrostatic latent image is formed on the circumferential surface of the photosensitive drum 18 by the laser light beam from the exposure unit 15. The developer 24 supplies the toner to the circumferential surface of the photosensitive drum 18, on which the electrostatic latent image is formed, to form the toner image corresponding to the electrostatic latent image. The toner image is then transcribed to the intermediate transcription belt 12. During the toner supply from the developer 24 to the photosensitive drum 18, the toner may adhere not only to the first region 76 in which the electrostatic latent image is formed but also accidentally to the second regions 78.

After the toner image is transcribed to the intermediate transcription belt 12, the second cleaning blades 58 suitably remove the toner accidentally adhering to the second regions 78. Then, the scrubbing roller 56 suitably removes the toner remaining in the first region 76. The first cleaning blade 52 further removes the toner still adhering to the first region 76. During the removal of the residual toner by the scrubbing roller 56 and the first cleaning blade 52, the seal members 74 suitably absorb the toner. Thus the toner is removed from the entirety of the circumferential surface of the photosensitive drum 18 by the cleaning portion 50, so that a new toner image is suitably formed.

According to the image forming apparatus 1 described referring to FIGS. 1 to 7, the electrostatic latent image is formed in the first region 76 of the drum unit 17. By supplying the toner from the developer 24, the toner image is formed in the first region 76. The developing roller 25 configured to supply the toner to the first region 76 is supported apart from the first region 76 in order to deliver an appropriate amount of the toner to the first region 76. Discs 26 adjacent to both ends of the developing roller 25 define the constant distance between the first region 76 and the circumferential surface of the developing roller 25. The toner image formed in the first region 76 is transcribed to the intermediate transcription belt 12.

During the toner supply from the developing roller 25 to the first region 76, the toner scattered from the developing roller 25 potentially adheres to the second regions 78 of the photosensitive drum 18. The toner adhering to the second regions 78 is suitably removed by the second cleaning blades 58. Further, the seal members 74 suitably prevent the toner from scattering in the second regions 78 during cleaning of the first region 76 by the first cleaning blade 52 and/or the scrubbing roller 56. Thus the toner adhering to the second regions 78 is reduced, so that the distance between the developing roller 25 and the first region 76 is hardly widened. Therefore problems such as lower toner concentration and uneven concentration resulting from the adherence of the toner to the second regions 78 are less likely to occur.

The cleaning portion 50 described referring to FIGS. 1 to 7 includes the first cleaning blade 52 to clean the first region 76 and the second cleaning blades 58 to clean the second regions 78. As a result, a setting to remove a larger amount of the toner (for the first cleaning blade 52) and a setting to remove a smaller amount of toner (for the second cleaning blades 58) are separately prepared. Therefore a noise (for example, sounds like a high pitched noise occurring when a rubber plate is rubbed against a dry glass surface), which may be likely to occur if the cleaning region of the first cleaning blade 52 is extended to the second cleaning regions 78 are well suppressed. Thus the toner adhering to the second regions 78 is suitably removed with less noise.

The blade portion 70 of the second cleaning blade 58 described referring to FIGS. 1 to 7 is connected to the holder 60 without using additional fastening means such as adhesive or connection process such as heat fusion. The holder 60 may be formed by bending leaf spring members. Therefore compared with the prior art, the second cleaning blade 58 may be more efficiently assembled. This contributes to reduction in manufacturing costs of the drum unit 17.

The fixing strength of the blade portion 70 to the holder 60 formed through the bending process is managed by measuring the dimensions of the holder 60 and/or the blade portion 70. This management method takes shorter time than what the blade portion assembly with fusion techniques or adhesion techniques requires such as the peeling tests for the strength management which are more complicated to take longer time. This contributes to the reduction in the manufacturing costs of the drum unit 17.

The holder 60 of the second cleaning blade 58 described referring to FIGS. 1 to 7 is provided along the intermediate transcription belt 12 transcribed the toner image from the photosensitive drum 18. This configuration does not require additional space to provide the second cleaning blade 58. Therefore the drum unit 17 may be less likely to enlarge. In addition, the holder 60 and the blade portion 70 extend in a direction opposing the movement direction of the circumferential surface of the photosensitive drum 18. Therefore the blade portion 70 in contact with the second region 78 with higher force suitably removes the toner on the second region 78.

The swaged claw portions 66 of the holder 60 are formed in a tapered plate shape. Therefore the swaged claw portions 66 are easily bent to suitably hold the blade 70. The grasping portions 65 and the swaged claw portions 66 bitten into the blade portion may suitably grasp and hold the blade portion 70 to provide a structure which may withstand the reaction force resulting from the contact between the second region 78 and the tip surface 73 of the blade portion 70.

The blade portion 70 protruding from the tip portion 64 of the holder 60 makes the grasping portions 65 and the swaged claw portions 66 distanced from the second region 78. As a result, the grasping portions 65 and the swaged claw portions 66 are less likely to collide with the second region 78.

The holder 60 may be suitably formed from stainless steel. As a result, the flexibility of the stainless steel is suitably facilitates to remove the toner on the second region 78. Further, it is preferable that the blade portion 70 formed from polyurethane rubber, which may also be used for the first cleaning blade 52 to remove the toner from the first region 76. This results in less manufacturing costs of the drum unit 17 in addition to suitable removal of the toner from the second region 78.

The photosensitive drum 18 described referring to FIGS. 1 to 7 is the a-Si drum with a longer lifetime. The assembly of the above-described holder 60 and blade portion 70 is less likely to degrade the long lifetime which is one of the advantageous characteristics of the a-Si drum.

The above embodiment primarily includes the following features.

The image carrier unit according to one aspect of the above embodiment includes an image carrier member configured to carry the toner image; and a cleaning portion configured to clean the image carrier member, wherein the cleaning portion includes a cleaning blade, the cleaning blade includes a blade portion in contact with the image carrier member, and a holder configured to partially surround and hold the blade portion, and the holder includes a swaged claw portion configured to bite into the blade portion.

According to the above configuration, the image carrier member configured to carry the toner image is cleaned by the cleaning portion. The cleaning portion includes a cleaning blade. The cleaning blade includes a blade portion in contact with the image carrier member and a holder configured to partially surround and hold the blade portion. The holder includes a swaged claw portion configured to bite into the blade portion, so that the blade portion is firmly held by the holder. Thus the blade portion is held without using additional fastening means such as adhesive. Therefore mounting of the blade portion is accomplished by a simpler method than the prior art.

In the above configuration, it is preferable that the image carrier member includes an image carrier surface including a first region in which the toner image is formed and a second region adjacent to the first region, in which the toner image is not formed. The cleaning blade includes a first cleaning blade configured to remove toner adhering to the first region and a second cleaning blade configured to remove toner adhering to the second region. The second cleaning blade includes the blade portion and the holder. The blade portion of the second cleaning blade makes contact with the second region.

According to the above configuration, the first cleaning blade removes toner from the first region in which toner images are formed, and the second cleaning blade removes toner adhering to the second region adjacent to the first region. Therefore during formation of the toner image in the first region of the image carrier surface, even when toner adheres to the second region adjacent to the first region, the cleaning portion may suitably remove toner adhering to the second region. Thus any problems resulting from the toner adhering to the second region is less likely to occur.

In the above configuration, it is preferable that the holder includes a grasping portion along a lateral surface of the blade portion. The swaged claw portion is a tapered plate-shape portion bent from the grasping portion.

According to the above configuration, the blade portion is suitably surrounded by the grasping portion and the swaged claw portion bent from the grasping portion. Further, the swaged claw portion is a tapered plate-shape portion configured to suitably bite into the blade portion. Thus the blade portion is held without using additional fastening means such as adhesive.

In the above configuration, it is preferable that a seal member is further provided to remove toner between a first cleaning region from which toner is removed by the first cleaning blade and a second cleaning region from which toner is removed by the second cleaning blade. The seal member forms a seal wall extending beyond a tip edge of the first cleaning blade in contact with the image carrier surface toward the second cleaning blade.

According to the above configuration, after toner is removed from the second cleaning region by the second cleaning blade, the seal member removes toner from the region between the first cleaning region from which toner is removed by the first cleaning blade and the second cleaning region. The seal member forms a seal wall extending beyond the tip edge of the first cleaning blade toward the second cleaning blade, so that toner scattered by the first cleaning blade is less likely to newly adhere to the second cleaning region. Thus any problems resulting from the toner adhering to the second region is less likely to occur.

In the above configuration, it is preferable that a scrubbing roller configured to remove toner from the first cleaning region within a region surrounded by the seal wall and the tip edge of the first cleaning blade is further provided. A circumferential surface of the scrubbing roller in contact with the image carrier surface is different in speed from the image carrier surface.

According to the above configuration, the circumferential surface of the scrubbing roller is different in speed from the image carrier surface, so that the circumferential surface of the scrubbing roller suitably scrubs the image carrier surface. Therefore the toner is suitably removed from the first cleaning region. The scrubbing roller removes the toner in the region surrounded with the tip edge of the first cleaning blade and the seal wall, so that toner scattered during the toner removal by the scrubbing roller is less likely to newly adhere to the second cleaning region. Thus any problems resulting from the toner adhering to the second region is less likely to occur.

In the above configuration, it is preferable that a developer configured to supply the toner to the image carrier surface is further provided. The developer includes a developing roller configured to supply the toner, and a disc configured to define a gap between a circumferential surface of the developing roller and the image carrier surface. The disc makes contact with the image carrier surface. The second cleaning region includes a contact region between the disc and the image carrier surface.

According to the above configuration, the second cleaning blade suitably removes toner from the second cleaning region. The second cleaning region includes the contact region between the disc and image carrier surface. Therefore the space between the image carrier surface and the developing roller is less likely to vary. Thus the toner supply from the developing roller is appropriately performed.

In the above configuration, it is preferable that a housing configured to support the second cleaning blade is further provided. The holder include a base portion connected to the housing and a tip portion configured to hold the blade portion and extend toward the image carrier surface. The blade portion protrudes from the tip portion of the holder so as to make contact with the image carrier member.

According to the above configuration, the holder extends toward the image carrier surface, and the blade portion protrudes from the tip portion of the holder so as to make contact with the image carrier member. Thus the blade portion extending from the tip portion of the holder may preferably remove toner on the image carrier surface.

In the above configuration, it is preferable that the housing include a support plate on which the base portion of the holder is placed, and an engaging piece protruding with respect to the support plate so as to engage the base portion of the holder together with the support plate.

According to the above configuration, the base portion of the holder is engaged with the support plate and the holder, so that the holder is appropriately connected to the housing.

In the above configuration, it is preferable that a clamp configured to fix the holder to the support plate is provided. The base portion of the holder includes a positioning piece along the support plate to position the holder so that the blade portion makes contact with the image carrier surface. The clamp is configured to pinch both the support plate and the positioning piece.

According to the above configuration, the blade portion is positioned appropriately so that the blade portion makes contact with the image carrier surface by the positioning piece along the support plate. The clamp pinches both the support plate and the positioning piece. Thus the holder is appropriately fixed to the support plate.

In the above configuration, it is preferable that the holder includes a narrower flexible portion between the base portion and the tip portion than the base portion and the tip portion. The engaging piece is inserted into a space defined by the base portion, the tip portion and the flexible portion.

According to the above configuration, elastic deformation of the flexible portion between the base portion and the tip portion moderates transmission of force resulting from the contact between the blade portion and the image carrier surface. Further, the engaging piece is inserted into a space defined by the base portion, the tip portion and the flexible portion to suitably engage with the base portion of the holder.

In the above configuration, it is preferable that the holder is formed from stainless steel, and that the blade portion is formed from polyurethane rubber.

According to the above configuration, the flexible holder may suitably remove toner from the second region. Further, the blade portion formed from polyurethane rubber may suitably remove toner from the second region.

In the above configuration, it is preferable that the image carrier surface include an amorphous silicone-based layer.

According to the above configuration, the image carrier surface may be more durable.

In the above configuration, it is preferable that the image carrier surface is a circumferential surface of a photosensitive drum on which an electrostatic latent image is formed.

According to the above configuration, the cleaning portion may suitably remove toner adhered to the second region of the circumferential surface of the photosensitive drum.

The image forming apparatus according to another aspect of the above embodiment forms a toner image on a sheet. The image forming apparatus includes an image carrier member configured to carry the toner image; a developer configured to form the toner image on the image carrier member; a relay unit to which the toner image is transcribed; the relay unit supplying the toner image to the sheet; and a cleaning portion configured to clean the image carrier member after transcription of the toner image to the relay unit, wherein the cleaning portion includes a cleaning blade, the cleaning blade includes a blade portion in contact with the image carrier member, and a holder configured to partially surround and hold the blade portion, and the holder includes a swaged claw portion configured to bite into the blade portion.

According to the above configuration, after the transcription of the toner image to the relay unit, the image carrier member configured to carry the toner image formed by the developer is cleaned by the cleaning portion. The cleaning portion includes a cleaning blade. The cleaning blade includes a blade portion in contact with the image carrier member, and a holder configured to partially surround and hold the blade portion. The holder includes a swaged claw portion configured to bite into the blade portion, so that the blade portion is firmly held by the holder. Thus the blade portion is held without using additional fastening means such as adhesive. Therefore mounting of the blade portion is accomplished by a simpler method than the prior art.

The image forming apparatus according to another aspect of the above embodiment forms a toner image on a sheet. The image forming apparatus includes an image carrier member configured to carry the toner image; a developer configured to form the toner image on the image carrier member; and a cleaning portion configured to clean the image carrier member after transcription of the toner image to the sheet, wherein the cleaning portion includes a cleaning blade, the cleaning blade includes a blade portion in contact with the image carrier member, and a holder configured to partially surround and hold the blade portion, and the holder includes a swaged claw portion configured to bite into the blade portion.

According to the above configuration, the image carrier member configured to carry the toner image formed by the developer is cleaned by the cleaning portion after the transcription of the toner image to the sheet. The cleaning portion includes a cleaning blade. The cleaning blade includes a blade portion in contact with the image carrier member, and a holder configured to partially surround and hold the blade portion. The holder includes a swaged claw portion configured to bite into the blade portion so that the blade portion is firmly held by the holder. Thus the blade portion is held without using additional fastening means such as adhesive. Therefore mounting of the blade portion is accomplished by a simpler method than the prior art.

What is claimed is:

1. An image carrier unit configured to carry a toner image, comprising:

an image carrier member configured to carry the toner image;

a cleaning portion configured to clean the image carrier member;

a seal member; and a developer, wherein the cleaning portion includes a cleaning blade, the cleaning blade includes a blade portion in contact with the image carrier member, and a holder configured to partially surround and hold the blade portion, the holder includes a swaged claw portion configured to bite into the blade portion, the image carrier member includes an image carrier surface including a first region in which the toner image is formed and a second region adjacent to the first region, in which the toner image is not formed, the cleaning blade includes a first cleaning blade configured to remove toner adhering to the first region and a second cleaning blade configured to remove toner adhering to the second region, the second cleaning blade includes the blade portion and the holder, the blade portion of the second cleaning blade makes contact with the second region the seal member is configured to remove toner between a first cleaning region from which toner is removed by the first cleaning blade and a second cleaning region from which toner is removed by the second cleaning blade, the seal member forming a seal wall extending beyond a tip edge of the first cleaning blade in contact with the image carrier surface toward the second cleaning blade, the developer includes a developing roller configured to supply toner to the image carrier surface, a disc configured to define a gap between a circumferential surface of the developing roller and the image carrier surface, the disc making contact with the image carrier surface, and the second cleaning region includes a contact region between the disc and the image carrier surface.

2. The image carrier unit according to claim 1, wherein the holder includes a grasping portion along a lateral surface of the blade portion, and the swaged claw portion is a tapered plate-shape portion bent from the grasping portion.

3. The image carrier unit according to claim 1, further comprising:

a scrubbing roller configured to remove toner from the first cleaning region within a region surrounded by the seal wall and the tip edge of the first cleaning blade, wherein a circumferential surface of the scrubbing roller in contact with the image carrier surface is different in speed from the image carrier surface.

4. The image carrier unit according to claim 1, further comprising a housing configured to support the second cleaning blade, wherein the holder includes a base portion connected to the housing and a tip portion configured to hold the blade portion, and extends toward the image carrier surface, and the blade portion protrudes from the tip portion of the holder so as to make contact with the image carrier surface.

5. The image carrier unit according to claim 4, wherein the housing comprises a support plate on which the base portion of the holder is placed, and an engaging piece protruding with respect to the support plate so as to engage with the base portion of the holder together with the support plate.

6. The image carrier unit according to claim 5, further comprising a clamp configured to fix the holder to the support plate, wherein the base portion of the holder includes a positioning piece along the support plate to position the holder so that the blade portion makes contact with the image carrier surface, and the clamp is configured to pinch both the support plate and the positioning piece.

7. The image carrier unit according to claim 5, wherein the holder comprises a narrower flexible portion between the base portion and the tip portion than the base portion and the tip portion, and the engaging piece is inserted into a space defined by the base portion, the tip portion and the flexible portion.

8. The image carrier unit according to claim 1, wherein the holder is formed from stainless steel, and the blade portion is formed from polyurethane rubber.

9. The image carrier unit according to claim 1, wherein the image forming surface includes an amorphous silicon-based layer.

10. The image carrier unit according to claim 1, wherein the image carrier surface is a circumferential surface of a photosensitive drum on which an electrostatic latent image is formed.

11. An image forming apparatus, which forms a toner image on a sheet, comprising:

the image carrier unit of claim 1;

a relay unit to which the toner image is transcribed; the relay unit supplying the toner image to the sheet; wherein the cleaning portion cleans the image carrier member after transcription of the toner image to the relay unit.

12. An image forming apparatus configured to form a toner image on a sheet, comprising:

the image carrier unit of claim 1;

the cleaning portion cleans the image carrier member after transcription of the toner image to the sheet.

* * * * *